United States Patent [19]

Olson

[11] 4,018,992

[45] Apr. 19, 1977

[54] DECODER FOR QUADRAPHONIC PLAYBACK

[75] Inventor: Lynn T. Olson, Portland, Oreg.

[73] Assignees: Clifford H. Moulton; Charles D. Wood, both of Portland, Oreg.

[22] Filed: Sept. 25, 1975

[21] Appl. No.: 616,555

[52] U.S. Cl. ..... 179/1 GQ; 179/100.4 ST

[51] Int. Cl. ..... H04R 5/00

[58] Field of Search ... 179/1 GQ, 15 BT, 100.4 ST, 179/100.1 TD

[56] References Cited

UNITED STATES PATENTS

| | | | |
|---|---|---|---|
| 3,708,631 | 1/1973 | Bauer et al. | 179/1 GQ |
| 3,772,479 | 11/1973 | Hilbert | 179/1 GQ |
| 3,821,471 | 6/1974 | Bauer | 179/1 GQ |
| 3,864,516 | 2/1975 | Kameoka et al. | 179/1 GQ |
| 3,919,480 | 11/1975 | Fukami | 179/1 GQ |
| 3,943,287 | 3/1976 | Gravereaux et al. | 179/1 GQ |
| 3,944,735 | 3/1976 | Willcocks | 179/1 GQ |

*Primary Examiner*—Douglas W. Olms
*Attorney, Agent, or Firm*—Oliver D. Olson

[57] ABSTRACT

Quadraphonically encoded left end right signals are fed to separate left and right signal phase shifters the outputs of which are fed to three variable gain amplifiers for each of the four corner loudspeakers of a quadraphonic playback system and also to three comparators which function to control operation of the variable gain amplifiers in such manner as to cancel cross talk by altering the decoding coefficients of the cross talk bearing channels.

8 Claims, 22 Drawing Figures

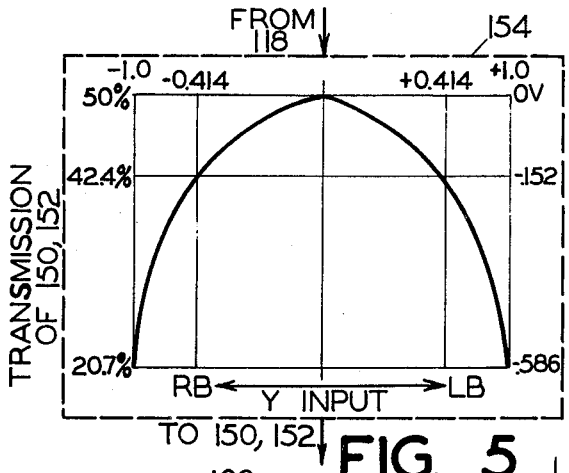

FIG. 5

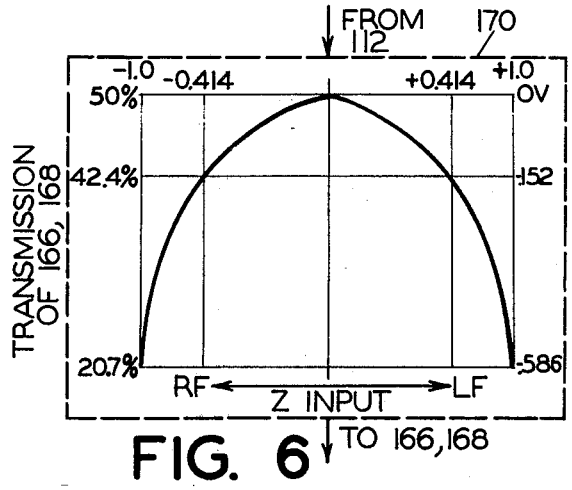

FIG. 6

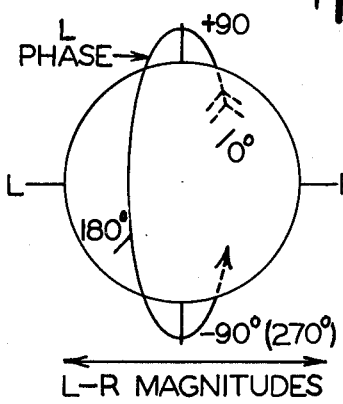

FIG. 7

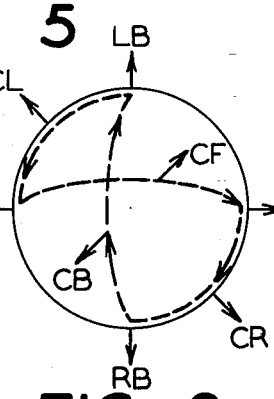

FIG. 8

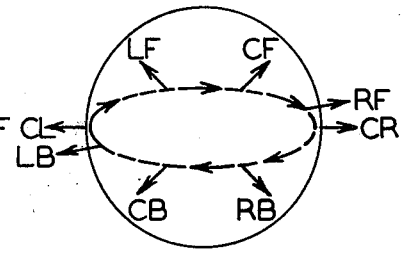

FIG. 9

$$\overset{32}{LF} = .7\overset{150,182}{g_{lf}}\left[\overset{10}{L} + \overset{26}{x_s}\left(.5\overset{12,72}{R} - .5L\right) + \frac{1+y}{\overset{20}{2}}\left(-\overset{12}{jR}\right) + \frac{1-y}{\overset{18}{2}}\left(\overset{12,86}{jR}\right)\right]$$

FIG. 10

$$\overset{68}{RF} = .7\overset{152,184}{g_{rf}}\left[\overset{12}{R} + \overset{140}{x_s}\left(.5L - .5\overset{12,56,58}{R}\right) + \frac{1+y}{\overset{54}{2}}\left(\overset{10,50}{jL}\right) + \frac{1-y}{\overset{52}{2}}\left(-\overset{10}{jL}\right)\right]$$

FIG. 11

$$\overset{46}{LB} = \overset{166,186}{g_{lb}}\left[-\overset{38}{x_{ss}}\left(.25\overset{10,36}{L} + .25\overset{10,70}{R} - .25\overset{10,48}{jL} - .25\overset{12,74}{jR}\right) - \frac{1+z}{\overset{40}{2}}\left(\overset{12,56}{R}\right) + \frac{1-z}{\overset{42}{2}}\left(\overset{10,50}{jL}\right)\right]$$

FIG. 12

$$\overset{84}{RB} = \overset{168,188}{g_{rb}}\left[-\overset{80}{x_{ss}}\left(.25\overset{10,50,92}{jL} + .52\overset{12,86,88}{jR} - .25\overset{10,22,90}{L} - .25\overset{12,56,94}{R}\right) - \frac{1+z}{\overset{78}{2}}\left(\overset{12}{jR}\right) + \frac{1-z}{\overset{76}{2}}\left(\overset{10}{L}\right)\right]$$

FIG. 13

DECODER FOR QUADRAPHONIC PLAYBACK

BACKGROUND OF THE INVENTION

This invention relates to quadraphonic sound systems, and more particularly to a decoder by which quadraphonic playback from a four channel recording on a stereo disc is achieved with maximum similarity to the four channel original master.

Matrix quadraphonic sound systems presently available involve the folding of four discrete channels into two, by encoding each of the four channels into distinct phase and amplitude characteristics in the two channel medium. It is then unfolded into four by means of a decoder.

Such systems provided heretofore are deficient in certain important respects: In a basic matrix system the conventional encode-decode sequence will position a sound source close to its intended location, but only if the listener is centrally seated and does not require that the source be as sharply defined as the four channel original master. For example, if a left front signal is presented to an encoder, the decoder will normally reproduce the left front signal at its intended location. However, cross talk also will appear at half power in the left rear and right rear channels, causing a subjective broadening of the original point source towards the rear pair of loudspeakers. A right front source will also appear in the two rear channels and a single channel source in the rear will also appear in both front channels.

The cross talk is much more noticeable to the non-central listener and also to the listener who moves his head. Such cross talk thus must be eliminated if an illusion of discreteness or resolution is to be obtained.

The conventional means for reducing such cross talk is to add to the basic matrix a circuit to sense the position of the momentarily loudest sound and to connect this sensing circuit to devices which reduce the gain in the channels which are expected to bear cross talk. For example, if the sensing device determines that left front is loudest, it reduces the gain on the two rear channels on the outputs of the basic decoder to prevent the cross talk from entering the loudspeakers.

In this second type of decoder the sound sources appear much sharper and appear to stand out from the background, independent of reverberation, even if the original four channel master had a gret deal of reverberation mixed in. In this regard, reverberation may be defined as a series of weak but important echoes, perhaps more than 20db down in level from the direct sound.

However, this second type of decoder, by its nature, suppresses reverberation since the sensing unit does not respond these low levels of sound. For example, if an instrument is playing in left front, the weak echoes encoded in left back and right back will appear at the outputs of the basic decoder, but so also will a much greater amount of cross talk from left front. The sensing unit "sees" the left front energy and shuts down the left back and right back outputs, thereby suppressing the reverberations, as well as the cross talk.

As previously mentioned, a basic decoder, ahead of the suppressing circuit, has poor front-to-rear separation. Accordingly, the weak rear reverberation is transferred as cross talk to the front, where it is not suppressed, and hence is permitted to appear along with the left front instrument. Accordingly, the listener, instead of hearing the hall reverberations in the rear, as in the original master, will hear it in the front, mixed along with orchestra, as in conventional stereo. Alternatively, the reverberations will flutter around the room if loud instruments stimulate front and rear parts of the decoder.

The foregoing conventional decode system may be characterized as having fixed decoding coefficients and one variable output gain per channel.

A third decode system provided heretofore may be characterized as having one variable decoding coefficient per channel and one variable output gain per channel, the variable coefficient being effective for eliminating cross talk coming from points exactly at center front or center rear. For example, when a center front signal appears, the rear channels are blended together electrically instead of being turned off. This makes them cancel a point source at center front only, and they pass all other non-cancelling sounds including rear reverberations. For sounds appearing in the corners, all reverberation is suppressed, as before.

FIG. 8 shows a Scheiber sphere illustrating the complex code used with the foregoing three examples of prior types of decoders.

A fourth decode system provided heretofore, but using a substantially different code, may be effectively characterized as having one variable decoding coefficient per channel. It can be made to alter the decoding characteristics themselves, rather than utilizing fixed decoding with variable gain. Thus, this type alters the decoding coefficients of the channels which are known to bear cros talk, to become identical with the one coefficient which cancels the source. For example, with this code, cross talk stemming from a left front source will appear at right front and left back, i.e. adjacent the source. Right front and left back then have their decoding coefficients altered, becoming the same as the silent channel which is this case, is right back. This cancels the crosstalk electrically, thereby eliminating it.

For the listener, this decoder system is effective over a full 360° circle in suppressing unwanted cross talk and retaining reverberation. However, it is limited to codes which are "regular ", i.e., which cut through a Scheiber sphere on a plane, as illustrated in FIG. 7. Thus, since it cannot be utilized with other conventional encoders, it is limited in its use with but one type of encoded disc.

A distinction can be drawn between the code of the first three examples and the code of the fourth example. The fourth code may be described as "regular" or simple, in that a signal encoded to travel in a circle around the listener on play back is plotted as a great circle on a Scheiber sphere, with the plotting lying on a plane cutting through the diameter of the sphere. This is shown in FIG. 9. A complex code is one whose plotting deviates from a plane when the signal is encoded to travel around the listener on playback. This is illustrated in FIG. 8. These are two examples that are shown to fall into two broad classes of complex and simple codes, with many other variations being used or contemplated in each class.

SUMMARY OF THE INVENTION

In its basic concept, the quadraphonic decoder of this invention involves the selective control of operation of two independently controlled variable gain amplifier units associated with each channel in such manner as to effectively provide two independent variable decoding coefficients per channel, thereby providing two axes of decoding freedom.

It is by virtue of the foregoing basic concept that the principal objective of this invention is achieved; namely, to overcome the aforementioned deficiencies and limitations of prior decoding systems.

The foregoing and other objects and advantages of this invention will appear from the following detailed description, taken in connection with the accompanying drawings of preferred embodiments.

BRIEF DESCRIPTION OF THE DRAWINGS

FIGS. 5 and 6 are waveforms produced by the shaping circuits of FIG. 4.

FIG. 7 is a rear view of a Scheiber phasor sphere affording explanation of the Scheiber notation, with left to right displacement corresponding to left to right magnitudes and with the circular arrow indicating the phase of the left channel referenced to the right.

FIGS. 8 and 9 are rear view of Scheiber phasor spheres illustrating the first three and the fourth prior art systems, respectively, described hereinbefore showing the encoded nature of a sound intended to travel clockwise around a listener.

FIGS. 10–13 are equations which define a decoder embodying the features of this invention, the terms of which are related to the electrical components of FIG. 1 by the same reference numerals.

DESCRIPTION OF THE PREFERRED EMBODIMENTS

Figure 1:
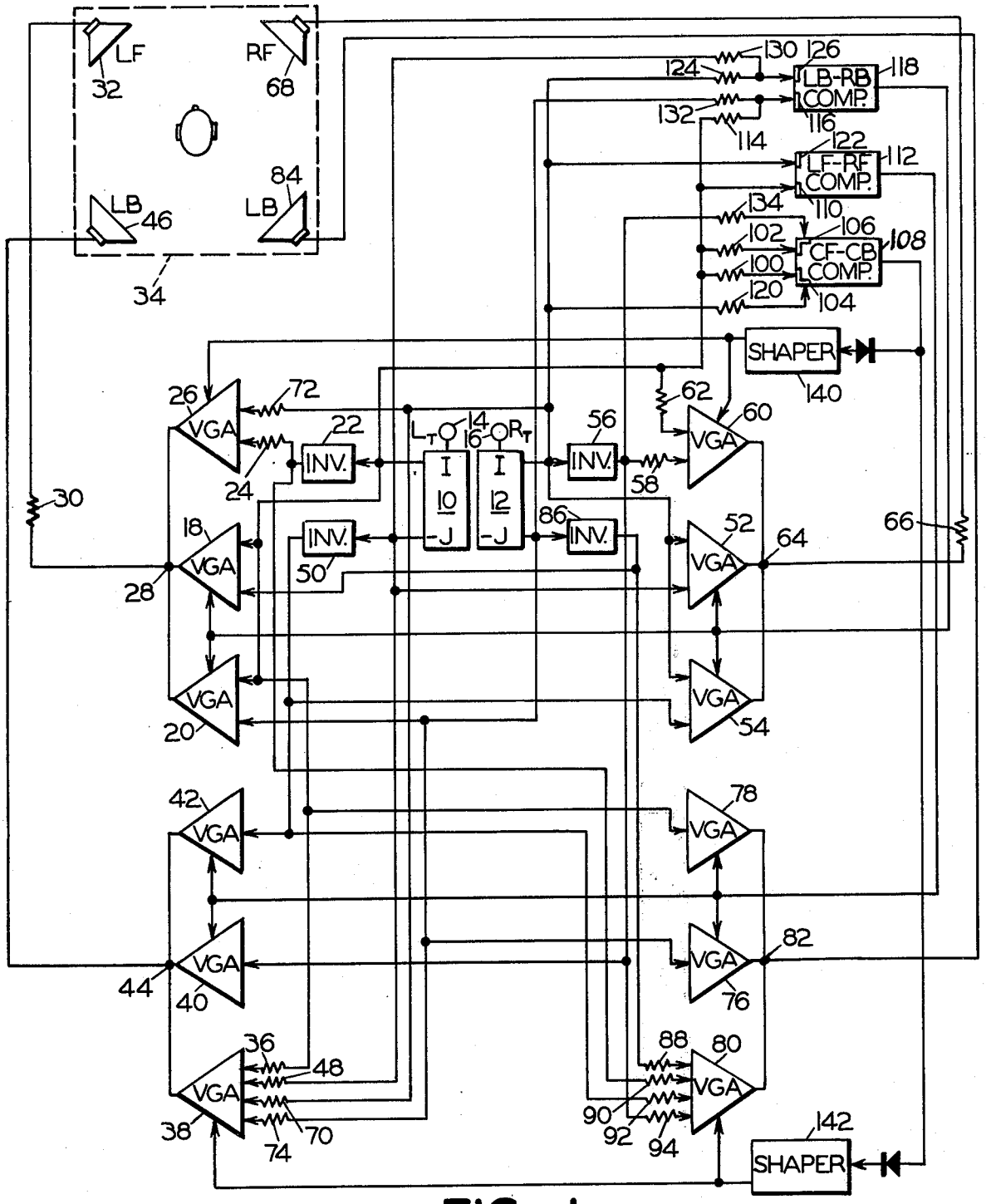
FIG. 1 is a schematic electrical diagram, in block form, of a quadraphonic decoder embodying the features of this ivention.

FIG. 1 of the drawings shows a pair of all-pass shifters 10 and 12 each providing a pair of outputs, one designed I for 0° and the other designed −J for −90°. The I output provides a reference phase through the audio frequency band, and the −J output is identical except that it lags behind the reference phase by 90°. The input 14 of the phase shifter 10 is adapted for connection to the output of the left channel of a quadraphonic encoder, while the input 16 of the other phase shifter is adapted for connection to the right channel output of the encoder.

It is to be understood that the quadraphonic encoder transforms at least four discrete sound channels into two output channels, herein designed $L_T$ and $R_T$. In practice these encoder outputs are recorded on a stereophonic record, magnetic tape, FM stereo, or any two-channel medium, the outputs of which are connected to the input terminals 14 and 16 of the phase shifters.

For the purposes of this invention, which is designed to give full separation with complex codes, the crosstalk bearing channels must be able to alter their decoding coefficients in two directions at once so as to fully cancel the complex motions of the source. Accordingly, for this invention two independently controlled variable gain amplifier units per channel are provided, each unit giving a different change in decoding coefficient thereby making it possible for each channel to alter its decoding coefficient in two directions simultaneously.

Thus, the I output of the phase shifter 10 is connected to one input of each of a complementary pair of variable gain amplifiers 18 and 20. It is also connected through a phase inverter 22 and an attenuator 24 to one input of a third variable gain amplifier 26. The outputs of the three variable gain amplifiers are connected together at a summation point 28 and thence through an attenuator 30 to the left front loudspeaker 32 in a listening room 34.

In the following description, when two or more inputs are connected to the same variable gain amplifier, it is to be understood that the inputs always remain isolated electrically from one another.

The I output of phase shifter 10 also is connected through an attenuator 36 to one input of a variable gain amplifier 38 associated with a complementary pair of variable gain amplifiers 40 and 42. The outputs of these three amplifiers are connected to a summation point 44 and thence to the left back loudspeaker 46 in the listening room.

The −J output of the phase shifter 10 is connected through an attenuator 48 to a second input of the variable gain amplifier 38. It also is connected through a phase inverter 50 to an input of the variable gain amplifier 42.

In the illustrated embodiment, the attenuator 24 provides reduction of signal to 50% of input; attenuator 30 reduces the signal to 70% of input; and attenuators 36 and 48 reduce the signals to 25% of input. These are referred to hereinafter as 50%, 70% and 25% attenuators, respectively.

In similar manner, the I output of the right channel phase shifter 12 is connected to one input terminal of each of the complementary pair of variable gain amplifiers 52 and 54. It also is connected through phase inverter 56 and 50% attenuator 58 to an input of the associated variable gain amplifier 60. This amplifier also is connected through 50% attenuator 62 to the I output of phase shifter 10. The outputs of these three amplifiers are connected to summation point 64 and thence through 70% attenuator 66 to the right front loudspeaker 68 in the listening room 34. The I output of phase shifter 12 also is connected through 25% attenuator 70 to a third input of amplifier 38, and also through 50% attenuator 72 to amplifier 26.

The −J output of the right channel phase shifter 12 is connected to a second input of variable gain amplifier 20 and also through a 25% attenuator 74 to a fourth input of variable gain amplifier 38. It also is connected to an input of variable gain amplifier 76 which forms a complementary pair with variable gain amplifier 78. This latter amplifier is connected to the I output of the left phase shifter 10. This complementary pair of amplifiers is associated with a third variable gain amplifier 80 and the outputs of all three are connected to summation point 82 and thence to the right back loudspeaker 84 in the listening room.

The −J output of the right channel phase shifter 12 also is connected through phase inverter 86 to a second input of the variable gain amplifier 18 and also through a 25% attenuator 88 to one input of the variable gain amplifier 80. A second input terminal of this amplifier is connected through a 25% attenuator 90 to the output of phase inverter 22 associated with the I output of the left channel phase shifter 10. A third input terminal of this amplifier is connected through a 25% attenuator 92 to the output of phase inverter 50 associated with the −J output terminal of the left channel phase shifter 10. The output of this phase inverter also is connected to an input terminal of the variable gain amplifier 54. A fourth input terminal of the amplifier 80 is connected through 25% attenuator 94 to the output of the phase inverter 56 associated with the I output of the right channel phase shifter 12. Said output of phase inverter 56 also is connected to an input terminal of the variable gain amplifier 40 of the left back complementary pair.

The phase inverters 22, 50 and 56, 86 are hereinafter considered as component parts with phase shifters 10 and 12, respectively to form phase shifting means. Their ouputs are referred to in FIGS. 10–13 as −L, +*j*L, −R, and +*j*R, respectively.

The I output of the left channel phase shifter 10 also is connected through 70% attenuators 100 and 102 to the center front and center back input terminals 104 and 106, respectively, of a comparator 108 which functions to compare in-phase and out-phase relations between the left and right signals signifying center front and center back. It also is connected to the left channel input terminal 110 of a second comparator 112 which functions to compare relative magnitudes of left and right signals, signifying left front and right front. It also is connected through a 70% attenuator 114 to the right back input terminal 116 of a third comparator 118 which functions to compare leading and lagging quadrature relations, signifying the presence of left back and right back signals.

The I output of the right channel phase shifter 12 is connected through a 70% attenuator 120 to the input terminal 104 of the first comparator 108, to the right channel input terminal 122 of the second comparator 112 and also through a 70% attenuator 124 to the left back input terminal 126 of the third comparator 118.

The −J output of the left channel phase shifter 10 is connected through a 70% attenuator 130 to the input terminal 126 of the third comparator 118, and the −J output terminal of the right channel phase shifter 12 is connected through the 70% attenuator 132 to the right back input terminal 116 of the third comparator. The output of the phase inverter 56 associated with the I output of the right channel phase shifter 12 is connected through a 70% attenuator 134 to the center back terminal 106 of the first comparator 108.

Figure 2:
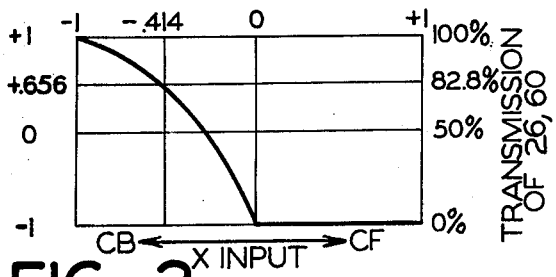
FIGS. 2 and 3 are waveforms produced by the shaping circuits of FIG. 1.
Figure 3:
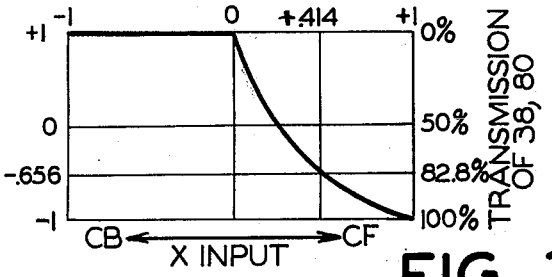

The output of the first comparator 108 is connected to the input of a pair of shaping circuits 140 and 142, by such means as the diodes illustrated, whereby the shapers receive input signals of opposite polarity. The output of shaping circuit 140, a typical waveform of which is shown in FIG. 2, is connected to the left front variable gain amplifier 26 and to the right front variable gain amplifier 60. The output of the other shaping circuit 142, a typical waveform of which is shown in FIG. 3, is connected to the left back amplifier 38 and to the right back amplifier 80.

The output of the second comparator 112 is connected to control circuitry of the left back and right back complementary pair of variable gain amplifiers while the output of the third comparator 118 is connected to control circuitry of the left front and right front complementary pairs of amplifiers.

It will appear from the equations of FIGS. 10–13 that when the control input to amplifiers 20, 16, 38, 40, 54, 60, 76 and 80 is −1 volt, the effective transmission is zero percent; when the control voltage is zero the transmission is 50 percent; and when the control voltage is +1 volt the transmission is 100 percent. When the control input to amplifiers 18, 42, 52 and 78 is +1 volt the transmission is zero percent; when the control voltage is zero the transmission is 50 percent; and when the control voltage is −1 volt the transmission is 100 percent.

It is important to note that transmission is a linear function of control voltage; and it is this linearity that enables the decoder to approach infinite separation.

It has been found the operation of the decoder described hereinbefore results in a 3 decibel rise in channel gain from the complementary pairs of variable gain amplifiers when one is at full transmission, and a 3 decibel drop in signal output from the associated separate amplifiers 26, 38, 60 and 80 when one is at full transmission. Compensation for these factors is desirable in order to provide constant gain in each channel, regardless of decoding coefficients, and may be accomplished in the manner illustrated in FIG. 4 of the drawings.

Thus, the control components of variable gain amplifiers 150 and 152 share a first connection to shaping circuit 154 the input of which is connected to comparator 118. This shaping circuit has a waveform as shown in FIG. 5. Amplifier 150 has a second control input connected through attenuators 156 and 158 to shaper 140 and inverter 160, respectively. Amplifier 152 has its second control input connected through attenuators 162 and 164 to shaper 140 and inverter 160, respectively. Inverter 160 is connected to the input of shaper 140.

In similar manner, the control components of variable gain amplifiers 166 and 168 share a first connection to shaping circuit 170 whose input is connected to comparator 112 and which has a waveform as shown in FIG. 6. Amplifier 166 has a second control input connected to attenuators 172 and 174 which are fed from inverter 176 and the input of shaper 142, respectively. Amplifier 168 has a second control input connected to attenuators 178 and 180 fed from inverter 176 and the input of shaper 142, respectively. Inverter 176 is fed from the output of shaper 142.

Amplifiers 150, 152, 166 and 168 each has a third control input of a positive bias of 0.229 volt that compensates for the quiescent negative voltage from shapers 140 and 142.

These amplifiers 150, 152, 166 and 168 also are paralleled with fixed gain amplifiers 182, 184, 186 and 188, respectively, all of which possess a gain of 0.5.

Attenuators 156, 162, 172 and 178 all serve to attenuate by a factor of 0.229, while attenuators 158, 164, 174 and 180 all attenuate by 0.457.

When the control input to amplifiers 150, 152, 166 and 168 is −1 volt the transmission is zero percent; when the control voltage is zero the transmission is 50 percent; and when the control voltage is +1 volt the transmission is 100 percent.

It is to be understood that the three control inputs of amplifiers 150, 152, 166 and 168 are isolated electrically from one another.

It will be appreciated that the foregoing arrangement of compensating shapers serves effectively to operate the variable gain amplifiers 150, 152, 166, and 168 to reduce by 3 decibels the inputs to the loudspeakers from the complementary pairs of amplifiers, during their negative input activation from shapers 154 and 170, and to increase by 3 decibels the inputs to the loudspeakers from the associated separate amplifiers, during their positive input activation from shapers 140 and 142. This keeps the gain of all channels precisely at unity at all times.

It is to be noted from FIGS. 10–13 that each complementary pair of variable gain amplifiers provides one variable decoding coefficient. For the front channels the variable control for the coefficient is *y*, and for the back channels the variable control for the coefficient is *z*. The associated single variable gain amplifier provides a second variable decoding coefficient. For both front and back channels the variable control for the coefficient is *x*. These amplifiers are independently variable and therefore they allow decoding variability along two independent axes of freedom, whereby the listener hears full 360° performance with a complex code. This is illustrated by the Scheiber phasor spheres of FIGS. 14–22. The basic explanation of the Scheiber sphere is in FIG. 7 and a complete disclosure of it is found in "Analyzing phase-amplitude matrices" by Peter Scheiber, Journal of the Audio Engineering Society, November 1971, Volume 19, pages 835–839.

The operating principle of this invention is demonstrated by the examples which follow. In this description it is to be understood that the phase angles and component parameters defined by the equations in FIGS. 10–13 are chosen for compatibility with an ideal code represented as follows:

| COMPARATOR OUTPUT | | | DECODER INPUT | | |
|---|---|---|---|---|---|
| x | y | z | $L_T$ | | $R_T$ |
| +1 | 0 | 0 | CF= .707 | 0° | 707 |
| 0 | 0 | −1 | RF= -0- | — | 1.00 |
| 0 | −.414 | −414 | CR= .383 | −90° | .924 |
| 0 | −1 | 0 | RB= .707 | −90° | .707 |
| −1 | 0 | 0 | CB= .707 | 180° | .707 |
| 0 | +1 | 0 | LB= .707 | +90° | .707 |
| 0 | +.414 | +.414 | CL= .924 | +90° | .383 |
| 0 | 0 | 1 | LF= 1.00 | — | -0- |

wherein $L_T$ and $R_T$ are the inputs to the left and right signal channels, respectively, it being assumed that the phase of $R_T$ is always zero; LF, RF, LB and RB designate playback channels, and CF, CB, CL and CR designate intermediate points between pairs of channels; *x* designates a control signal from comparator 108 varying between +1 and −1 and derived by *a*CF−*a*CB/*a*CF+*a*CB, wherein *a*CF is the average energy at terminal 104 and *a*CB is the average energy at terminal 106; $x_s$ is *x* modified by shaping circuit 140; $x_{ss}$ is *x* modified by shaping circuit 142; *y* designates a control signal from comparator 118 varying between +1 and −1 and derived by *a*LB − *a*RB/*a*LB + *a*RB, wherein *a*LB is the average energy at terminal 126 and *a*RB is the average energy at terminal 116; *z* designates a control signal from comparator 112 varying between +1 and −1 and derived by *a*LF − *a*RF/*a*LF + *a*RF, wherein *a*LF is the average energy at terminal 110 and *a*RF is the average energy at terminal 122; *g* designates overall gain resulting from transmission level of variable gain amplifiers 150, 152, 166 and 168 which, in turn, are controlled by shaping circuits 140, 142, 154 and 170. These latter circuits are driven by *x*, *y* and *z* control signals. The gain factor *g* may be ignored for computations of interchannel separation.

From the foregoing equations it will be seen that *z*, *y* and *z* are independent control signals which represent the three orthogonal axes on the Scheiber spheres illustrated in the drawing.

The following examples are related to certain of the Scheiber phasor spheres in FIGS. 14–22. In this regard, it is to be understood that the diverging arrows representing the identified channels are spaced apart merely for clarity. In practice, the divergence of these arrows is very slight.

Figure 14:
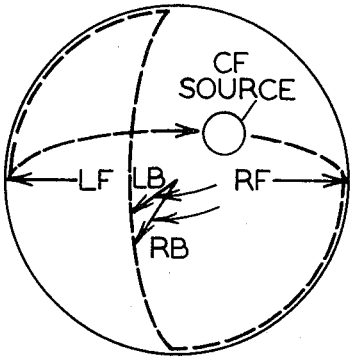
FIGS. 14–22 are rear views of Scheiber phasor spheres illustrating the movement of decode coefficients in response to clockwise movement of a source around a listener.

As a first example, let it be assumed that the encoder output provides a signal representing the center front (CF) channel. This is illustrated in FIG. 14. As indicated hereinbefore, this signal constitutes 0.707 volt at 0° phase applied to the input 14 of the left channel phase shifter 10, and 0.707 volt at 0° applied to the input terminal 16 of the right phase shifter 12. This provides comparator 108 with an ouput of +1.0 volt and comparators 112 and 118 with zero output voltage.

With reference to the equation of FIG. 12, the variable gain amplifier 42 of the complementary pair receives zero control voltage from comparator 112 and therefore yields a gain of 0.5. It is fed with a voltage of 0.707 volt and +90°phase derived by passing the −J output of phase shifter 10 to inverter 50. This provides the variable gain amplifier 42 with a output of summation point 44 of 0.35 volt at +90°.

The second variable gain amplifier 40 of the complementary pair in this channel also receives zero control voltage from comparator 112, thereby yielding a gain of 0.5. It is fed with 0.707 volt at 180° phase, derived by passing the I output of phase shifter 16 through inverter 56. The output of variable gain amplifier 40 thus is 0.35 volt at 180°.

The third, separate variable gain amplifier 38 of the left back channel receives a control signal of −1.0 volt from shaper 142 which receives +1.0 volt from the output of comparator 108. This provides the variable gain amplifier 38 with a gain of 1.0.

Variable gain amplifier 38 receives 0.17 volt at 0° from attenuator 36 wich is fed by the I output of phase shifter 10.

Variable gain amplifier 38 also receives 0.17 volt at −90° from attenuator 48 which is fed by the − J output of phase shifter 10.

Amplifier 38 also receives 0.17 volt at 0° from attenuator 70 which is fed by the I output of phase shifter 12. It also receives 0.17 volt at −90° from attenuator 74 which is fed by the −J output of phase shifter 12.

Accordingly, the variable gain amplifier 38 has an output of 0.5 volt at −45°.

The outputs of the variable gain amplifiers 38, 40 and 42 thus add up to zero at summation point 44.

Figure 4:
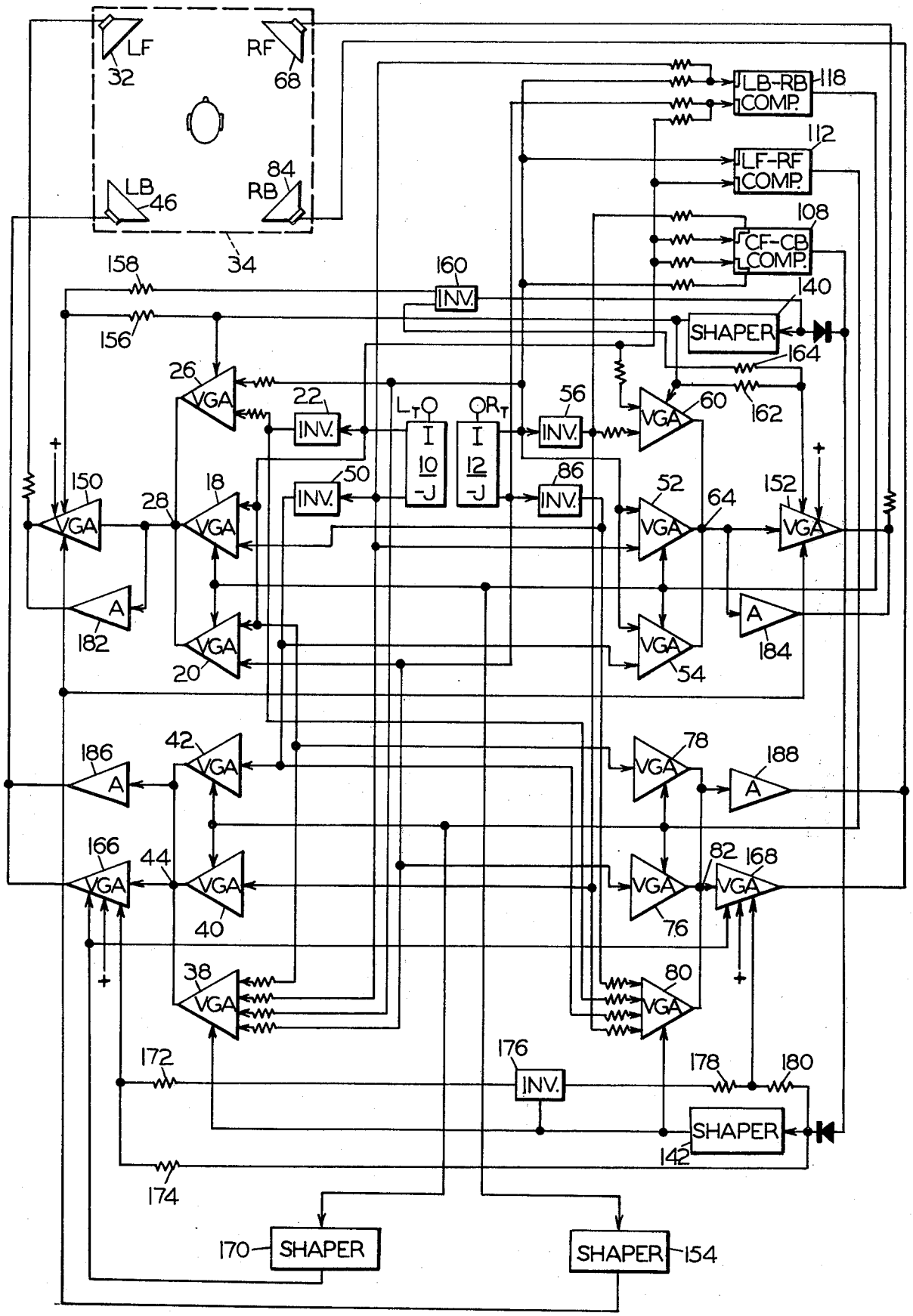
FIG. 4 is a schematic electrical diagram, in block form, of a modified form of quadraphonic decoder embodying the features of this invention.

This point 44 may be connected in parallel with fixed gain amplifier 186, with a gain of 0.5, and variable gain amplifier 166 (FIG. 4). Amplifier 166 has a bias voltage of +0.228 volts on one input terminal and a positive voltage of 0.686 on a second input terminal. This voltage is derived from attenuators 172 and 174 which are fed, respectively, by inverter 176 and the input of shaper 142 to which +1.0 volt is provided by comparator 108. The output of shaper 142 drives inverter 176 thereby causing amplifier 166 to have a drive of +0.914 volt. Shaper 170 is inactive since it is provided no control voltage from comparator 112.

Although there is no voltage output from amplifier 166, this correction of +3db permits the overall gain of the left back channel to remain constant, so that weak reverberant energy may pass through unaffected.

With reference to FIG. 14, points on the Scheiber sphere that are 180° apart are understood to have infinite separation. Points that are 90° apart in any direction are understood to have 3db of separation. Accordingly, it is apparent from FIG. 14 that the rear channels display infinite separation since they are 180° away from the center front source. Further, it will be seen in FIGS. 15–22 that the channels that usually would bear cross talk are at all times positioned 180° away from the source, and therefore are silent, i.e. they have infinite separation from the source.

Figure 15:
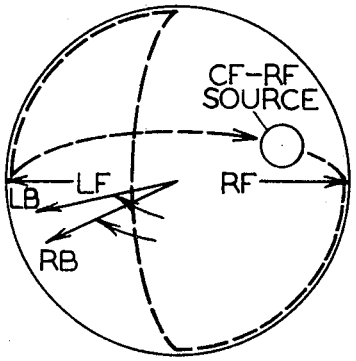

As a second example, let it be assumed that the encoder output provides a signal representing a center front-right front (CF-RF) position. This is illustrated in FIG. 15. This signal constitutes 0.383 volt at 0° phase applied to the input 14 of the left channel phase shifter 10, and 0.924 volt at 0° phase applied to the input terminal 16 of the right phase shifter 12. This provides comparator 108 with an ouput of +0.414 volt, comparator 112 with an output of −0.414 volt, and comparator 118 with no output voltage.

Referring again to the equation in FIG. 12, the variable gain amplifier 42 of the complementary pair is provided with a control voltage of −0.414 volt from comparator 112, yielding a gain of 0.707. It is fed with 0.383 volt at +90° derived by passing the −J output of phase shifter 10 through inverter 50. This provides the amplifier 42 with an output of 0.271 volt at +90°.

The second variable gain amplifier 40 of the complementary pair receives a control voltage of −0.414 volt from comparator 112, providing a gain of 0.293. It is fed with 0.924 volt at 180° phase, derived by passing the I output of phase shifter 12 through inverter 56. This provides the amplifier 40 with an output of 0.271 volt at 180°.

The separate varible gain amplifier 38 receives −0.828 volt control signal from shaper 142 which, in turn, receives +0.414 volt from comparator 108. This provides the amplifier 38 with a gain of 0.828.

The amplifier 38 receives 0.096 volt at 0° from attenuator 36; 0.096 volt at −90° from attenuator 48; 0.231 volt at 0° from attenuator 70, and 0.231 volt at −90° from attenuator 74. Accordingly, the input of amplifier 38 is 0.462 volt at −45°. Since the gain is 0.828, the amplifier 38 has an output of 0.383 volt at −45°.

The outputs of the variable gain amplifiers 38, 40 and 42 at summation point 44 add up to zero. As previously discussed, this point 44 may be connected in parallel with fixed gain amplifier 186 and variable gain amplifier 166 (FIG. 4). Together, these amplifiers have a gain of 1.21 when fed a total of +0.414 volt from shapers 170 and 142, with the output of the latter inverted at 176 and attenuated at 172, with a direct path to the input of shaped 142 through attenuator 174 and fixed bias input of +0.228 volt.

This results in an output of zero volt but the gain is maintained constant so that weak reverberant energy may pass through unaffected.

Figure 16:
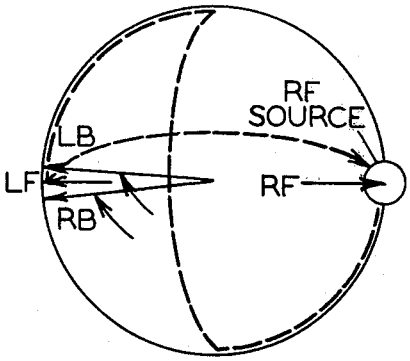
Figure 17:
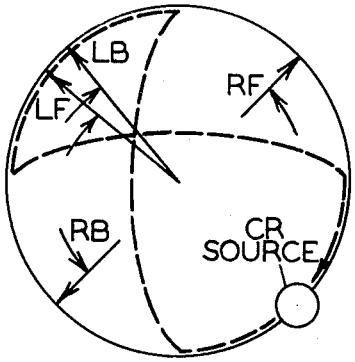
Figure 18:
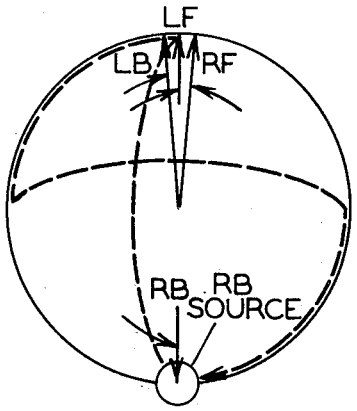
Figure 19:
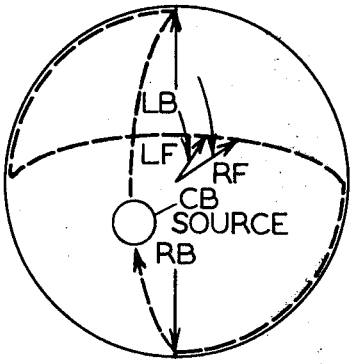
Figure 20:
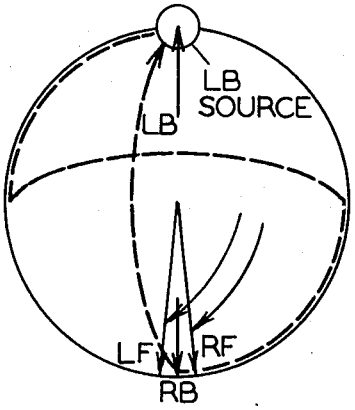
Figure 21:
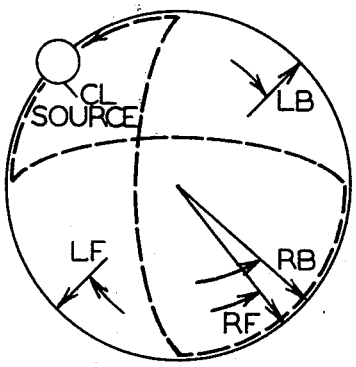
Figure 22:
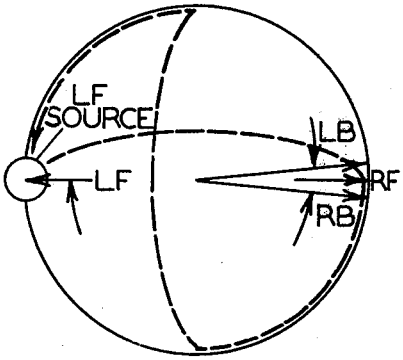

As a third example, let it be assumed that the encoder output provides a signal representing the right front (RF) channel. This is illustrated in FIG. 16. As indicated hereinbefore, this signal constitutes 1.0 volt at 0° phase applied to the input terminal 16 of the right channel phase shifter 12. This provides comparators 108 and 118 with zero ouput voltage and comparator 112 with an output of −1.0 volt.

With reference once again to the equation in FIG. 12, the variable gain amplifier 42 of the complementary pair is provided with −1.0 volt control voltage, yielding a gain of 1.0. It is provided with zero voltage from phase shifter 10 and hence has zero output voltage.

The second variable gain amplifier 40 of the complementary pair receives a control voltage of −1.0 volt from comparator 112, providing zero gain. It is fed with 1.0 volt at 180° phase, derived by passing the I output of phase shifter 12 through inverter 46. It has zero output voltage.

The separate variable gain amplifier 38 receives no control signal from shaper 142, since the latter receives no voltage from comparator 108. This provides the amplifier 38 with zero gain.

Amplifier 38 receives no voltage from attenuators 36 and 48. However, it receives 1.0 volt at 0° from attenuator 70 amd 1.0 volt at −90° from attenuator 74, and hence has zero output. Accordingly, the output voltage at summation point 44 is zero.

In FIG. 4, summation point 44 is connected in parallel with fixed gain amplifier 186 and variable gain amplifier 166 which together have a gain of 0.7 when fed −0.586 volt from shaper 170 which, in turn, is fed −1.0 volt from comparator 112. Although this results in zero output, the correction permits the overall gain of the channel to remain constant so that weak reverberant energy may pass through unaffected.

As a fourth example, let it be assumed that the encoder output provides a signal representing the center right (CR) channel. As previously indicated, this signal constitutes 0.383 volt at −90° applied to the input 14 of the left channel phase shifter 10, and 0.924 volt at 0° phase applied to the input terminal 16 of the right phase shifter 12. This provides comparator 108 with zero output voltage and comparators 112 and 118 both with −0.414 volt output.

Referring again to the equation of FIG. 12, the variable gain amplifier 42 of the complementary pair is provided with −0.414 volt control from comparator 112, yielding a gain of 0.707. It is fed 0.383 volt at 0° phase, derived by passing the −J output of phase shifter 10 through inverter 50. This provides amplifier 42 with an output of 0.271 volt at 0° phase.

The other amplifier 40 of the complementary pair receives a control voltage of 0.414 volt from comparator 112, providing a gain of 0.283. It is fed with 0.924 volt at 180° phase, derived by passing the I output of phase shifter 12 through inverter 56. This provides the amplifier 40 with an output of 0.271 volt at 180° phase.

The separate amplifier 38 receives no control signal from shaper 142, since the latter receives no signal from comparator 108. This provides the amplifier with a gain of zero, whereby input voltage through the attenuators 36, 48, 70 and 74 are of no consequence.

The sum of the outputs of amplifiers 40 and 42 is zero at the summation point 44.

This summation point 44 may be connected in parallel with fixed gain amplifier 186 and variable gain amplifier 166 (FIG. 4). Although the output therefrom is zero, the overall gain of the channel remains constant so the weak reverberent energy may pass through unaffected.

It will be apparent from the foregoing examples that the two independently controlled variable gain amplifier units associated with each channel afford two axes of freedom of decoding. Accordingly, an infinite number of playback points are rendered, with full separation, throughout the full 360° panning circle and along the two diagonal splits. Indeed, any position of which the code is capable is delivered with full separation. The optional third amplifiers 150, 152, 166, 168 of FIG. 4 provide a third variable coefficient which functions to precisely maintain the gain of the overall circuit constant.

It is by this means that the decoder of this invention achieves maximum performance of playback from the two channel recording of a multi-channel master. It exhibits no suppression of reverberant information, regardless of the channel combinations, and it displays full separation on any combination of channels in the code.

It will be apparent to those skilled in the art that various changes may be made in the type, number and arrangement of circuit components described hereinabefore. For example, the mathematical equations and the corresponding magnitudes and phases of the various parameters are merely illustrative of an encoder and a corresponding decoder, and may be changed as desired to accommodate other complex codes and to achieve changes in loudspeaker phase. The complementary pairs of variable gain amplifiers, forming one unit of each pair of units associated with each channel, may be replaced by a single amplifier. Indeed, an amplifier system may be provided incorporating a unit common to one pair of channels and providing two variables per channel, and another unit common to another pair of channels and providing two variables per channel. These and other modifications and changes may be made, as desired, without departing from the spirit of this invention.

Having now described my invention and the manner in which it may be used, I claim:

1. A decoder for reproducing on at least four separate loudspeakers adapted to be disposed at left front, right front, left back and right back positions relative to a listener at least four separate audio intelligence signals encoded into a pair of input channel signals having preselected amplitude and phase relationships, the decoder comprising:

a. a pair of independently controlled variable gain amplifier units for each loudspeaker for providing two independently variable decoding coefficients per loudspeaker, b. phase shifting means for each of the pair of input channel signals each having an input adapted for connection to the corresponding channel and each having a plurality of outputs providing output signals of different phases which are connected to inputs of the variable gain amplifier units, and c. three independent signal comparing means one of which is responsive to the ratio between left front and right front signals, the second of which is responsive to the ratio between left back and right back signals, and the third of which is responsive to the ratio between center front and center back signals, the comparing means having inputs connected to selected derived outputs of the phase shifting means and having control signal outputs connected to the pairs of variable gain amplifier units for selectively controlling operation of each unit, whereby to achieve full separation at any point on a 360° circle about a listener by varying two decoding coefficients simultaneously for each loudspeaker.

2. The decoder of claim 1 including compensating amplifier means interconnecting each pair of variable gain amplifier units and its associated loudspeaker and operable to maintain the gain of the associated channel at unity at all times.

3. The decoder of claim 2 including signal shaping means interconnecting the signal comparing means and said compensating amplifier means for operating the latter.

4. The decoder of claim 1 wherein one amplifier unit of each pair comprises a complementary pair of gain amplifiers one operable upon application thereto of an electric control signal of a polarity opposite that applied to the other amplifier of the pair.

5. A decoder for reproducing on at least four separate loudspeakers adapted to be disposed at left front, right front, left back and right back positions relative to a listener at least four separate audio intelligence signals encoded into a pair of input channel signals representing left and right channels and having preselected amplitude and phase relationships, the decoder comprising:

a. a pair of independently controlled variable gain amplifier units for each loudspeaker for providing two independently variable decoding coefficients per loudspeaker, b. phase shifting means for each of the pair of input channel signals each having an input adapted for connection to the corresponding channel signal and each having a plurality of outputs providing output signals of different phases which are connected to inputs of the variable gain amplifier units, and c. a plurality of independent signal comparing means having inputs connected to selected derived outputs of the phase shifting means and having control signal outputs connected to the pairs of variable gain amplifier units for selectively controlling operation of each unit, whereby to achieve full separation by varying two decoding coefficients simultaneously for each loudspeaker, the plurality of signal comparing means comprising 1. first signal comparing means for comparing left-to-right magnitudes and having a pair of signal inputs one connected to an output of the left phase shifting means and the other connected to the output of the right phase shifting means, and a control signal output connected to one amplifier unit associated with each of the back loudspeakers, 2. second signal comparing means for comparing leading and lagging quadrature phase relations between channel signals and having a pair of signal inputs each connectd to different outputs of the left and right phase shifting means, and a control signal output connected to the amplifier unit associated with each front loudspeaker, 3. third signal comparing means for comparing in-phase and out-phase relations between left and right signals and having a pair of signal inputs each connected to different outputs to different outputs of the left and right phase shifting means, and a control signal output, 4. first signal shaping means having a signal output connected to the other amplifier unit of each pair associated with the left front and right front loudspeakers and operative to activate said amplifier units with a shaped signal of predetermined polarity, and a control signal input connected to the control signal output of the third signal comparing means, and 5. second signal shaping means having a signal ouput connected to the other amplifier unit of each pair associated with the left back and right back loudspeakers and operative to activate said amplifier units with a shaped signal of polarity opposite the polarity of the first shaped signal, and a control signal input connected to the control signal output of the third signal comparing means.

6. The decoder of claim 5 including compensating amplifier means interconnecting each pair of variable gain amplifier units and its associated loudspeaker, first signal shaping means having an input connected to the output of the first signal comparing means and an output connected to the compensating amplifier means associated with the left front and right front loudspeakers, and second signal shaping means having an input connected to the output of the second signal comparing means and an output connected to the compensating amplifier means associated with the left back and right back loudspeakers.

7. A decoder for reproducing on at least four separate loudspeakers adapted to be disposed at left front, right front, left back, and right back positions relative to a listener at least four separate audio intelligence signals encoded into a pair of input channel signals representing left and right channels and having preselectd amplitude and phase relationships, the decoder comprising:

a. a pair of independently controlled variable gain amplifier units for each loudspeaker for providing two independently variable decoding coefficients per loudspeaker, one amplifier unit of each pair comprising a complementary pair of variable gain amplifiers one operable upon application thereto of an electric control signal of a polarity opposite that applied to the other amplifier of the pair, b. phase shifting means for each of the pair of input channel signals each having an input adapted for connection to the corresponding channel signal and each having a plurality of outputs providing output signals of different phases which are connected to inputs of the variable gain amplifier units, and c. a plurality of independent signal comparing means having inputs connected to selected derived outputs of the phase shifting means and having control signal outputs connected to the pairs of variable gain amplifier units for selectively controlling operation of each unit, whereby to achieve full separation by varying two decoding coefficients simultaneously for each loudspeaker, the plurality of signal comparing means comprising 1. first signal comparing means for comparing left-to-right magnitudes and having a pair of signal inputs one connected to an output of the left phase shifting means and the other connected to the output of the tight phase shifting means, and a control signal output connected to the complementary pair of amplifiers associated with the back loudspeakers and operative to activate one amplifier of each pair with a negative signal and to activate the other amplifier of each pair with a positive signal, 2. second signal comparing means for comparing leading and lagging quadrature phase relations between channel signals and having a pair of signal inputs each connected to different outputs of the left and right phase shifting means, and a control signal output connected to the complementary pairs of amplifiers associated with the front loudspeakers and operative to actuate one amplifier of each pair with a negative signal and to activate the other amplifier of each pair with a positive signal, 3. third signal comparing means for comparing in-phase and out-phase relations between left and right signals and having a pair of signal inputs each connected to different outputs of the left and right phase shifting means, and a control signal output, 4. first signal shaping means having a signal output connected to the other amplifier unit of each pair associated with the left front and right front loudspeakers and operative to activate said units with a shaped signal of predetermined polarity, and a control signal input connected to the control signal output of the third signal comparing means, and 5. second signal shaping means having a signal output connected to the other amplifier unit of each pair associated with the left back and right back loudspeakers and operative to activate said units with a shaped signal of polarity opposite the polarity of the first shaped signal, and a control signal input connected to the control signal output of the third signal comparing means.

8. The decoder of claim 7 including compensating amplifier means interconnecting each pair of variable gain amplifier units and its associated loudspeaker, first signal shaping means having an input connected to the output of the first signal comparing means and an output connected to the compensating amplifier means associated with the left front and right front loudspeakers, nd second signal shaping means having an input connected to the output of the second signal comparing means and an output connected to the compensating amplifier means associated with the left back and right back loudspeakers.

* * * * *

UNITED STATES PATENT AND TRADEMARK OFFICE

CERTIFICATE OF CORRECTION

PATENT NO. : 4,018,992
DATED : 19 April, 1977
INVENTOR(S) : LYNN T. OLSON

It is certified that error appears in the above-identified patent and that said Letters Patent are hereby corrected as shown below:

Abstract, first line, "end" should read --and--.

Column 10, line 18, "amd" should read --and--.

12, line 11, "gain" should read --variable gain--.
12, line 54, "connectd" should read --connected--.
12, line 61, "to different outputs" should be deleted.
13, line 31, "lectd" should read --lected--.
14, line 5, "tight" should read --right--.
14, line 52, "nd" should read --and--.

Signed and Sealed this

*second* Day of *August 1977*

[SEAL]

*Attest:*

RUTH C. MASON
*Attesting Officer*

C. MARSHALL DANN
*Commissioner of Patents and Trademarks*